US008956075B1

(12) United States Patent
Free et al.

(10) Patent No.: US 8,956,075 B1
(45) Date of Patent: Feb. 17, 2015

(54) TUNNEL MOLD, SYSTEM AND METHOD FOR SLIP FORMING REINFORCED CONCRETE STRUCTURES WITH EXPOSED REBARS

(71) Applicants: Patrick Shawn Free, West Palm Beach, FL (US); Eric C Kontos, Boca Raton, FL (US)

(72) Inventors: Patrick Shawn Free, West Palm Beach, FL (US); Eric C Kontos, Boca Raton, FL (US)

( * ) Notice: Subject to any disclaimer, the term of this patent is extended or adjusted under 35 U.S.C. 154(b) by 0 days.

(21) Appl. No.: 14/161,741

(22) Filed: Jan. 23, 2014

Related U.S. Application Data

(63) Continuation-in-part of application No. 14/071,629, filed on Nov. 4, 2013, now Pat. No. 8,920,068.

(51) Int. Cl.
*E01C 21/00* (2006.01)
*E01C 19/48* (2006.01)
*E01D 21/00* (2006.01)

(52) U.S. Cl.
CPC ..... *E01C 19/4866* (2013.01); *E01D 21/00* (2013.01)
USPC ..... 404/75; 404/98; 404/105; 404/106; 404/108; 14/73; 14/77.1; 425/192 R

(58) Field of Classification Search
CPC ..... E01C 19/4866; E01D 21/00
USPC ..... 404/72–75, 101, 105–107; 14/73, 77.1; 425/192 R
See application file for complete search history.

(56) References Cited

U.S. PATENT DOCUMENTS

| | | | | | |
|---|---|---|---|---|---|
| 3,792,133 | A * | 2/1974 | Goughnour | 264/33 |
| 4,084,928 | A * | 4/1978 | Petersik | 425/64 |
| 4,093,410 | A * | 6/1978 | Miller | 425/59 |
| 4,266,917 | A * | 5/1981 | Godbersen | 425/64 |
| 5,290,492 | A * | 3/1994 | Belarde | 264/33 |
| 5,354,189 | A * | 10/1994 | McKinnon | 425/64 |
| 8,573,886 | B1 * | 11/2013 | Taylor, Jr. | 404/98 |
| 2002/0039519 | A1 * | 4/2002 | Piccoli et al. | 404/98 |
| 2010/0129151 | A1 * | 5/2010 | Guntert et al. | 404/72 |
| 2012/0128417 | A1 * | 5/2012 | Zimmermann et al. | 404/72 |

* cited by examiner

*Primary Examiner* — Raymond W Addie
(74) *Attorney, Agent, or Firm* — John H. Faro, Esq

(57) ABSTRACT

A slip-mold having a housing having (a) concrete hopper having (b) means for distribution of quick set concrete within said hopper, (c) a mold cavity, and (d) at least one tunnel, in communication with said mold cavity, and extending through said housing from the leading to the trailing end of said housing. The tunnel through the housing is of sufficient height and width, and positioned within said mold housing, to permit rebars, extending from an iron work array, to pass through said mold cavity without becoming embedded in concrete, concurrent with the formation of a slip formed concrete structure on a portion of said iron work array.

22 Claims, 12 Drawing Sheets

TUNNEL MOLD, SYSTEM AND METHOD FOR SLIP FORMING REINFORCED CONCRETE STRUCTURES WITH EXPOSED REBARS

CROSS-REFERENCE TO RELATED COMMONLY ASSIGNED APPLICATION

This application is a continuation-in-part of a prior filed, co-pending patent application, entitled Process For Slip Forming Reinforced Bridge Coping With Exposed Rebars, Ser. No. 14/071,629 filed on Nov. 4, 2013. Both the prior filed, co-pending patent application and the instant patent application have been commonly assigned to Raptor LLC (A Florida Limited Liability Company)

BACKGROUND OF THE INVENTION

1. Field of the Invention

This invention relates to a device, system and method for slip forming reinforced concrete structures. More specifically, this invention is directed to a tunnel mold having at least one tunnel through the mold, to a slip molding system utilizing a tunnel mold and to the method for the slip forming a reinforced concrete structure having a reinforcing iron work array, (also "rebars"), wherein a portion of the iron work array is embedded in a slip formed concrete structure; and, a portion of the iron work array extends from within the slip formed, reinforced concrete structure. The portion of reinforcing iron work array, (rebars") which extends from within the slip formed concrete structure, is and remains essentially concrete free concrete later integration into yet another slip formed structure. These extending reinforcing bars are suitable for subsequent reinforcement, and integration, with an additional in situ formed concrete structures, so as to further integrate such additional in situ formed concrete structures with the reinforced concrete road structures produced by this process. The concrete structures produced with a slip mold of this invention, are seamless, and formed in place, so as to better conform to the supporting surface on which they are formed.

2. Description of the Prior Art

Slip forming of concrete structures is a well-known technique for preparation of structural concrete elements for various industrial and public works (road, conduit, etc.) projects. Slip forming is a construction method in which a quick setting concrete is poured into the mold cavity of a slip-mold, and the slip-mold is progressively advanced or slipped over an iron work array composed of rebars, while the slip mold cavity of the progressively advanced over the iron work array. The rate of advancement of the mold, relative to the iron work array, is determined, in part, by the green strength of quick setting concrete in the formed concrete structure, specifically, the extent to which the concrete in the formed structure is self supporting, and is capable of supporting a forward advancing mass of unset concrete, as this advancing mass of concrete leaves the confines of the slip-mold.

Slip forming enables continuous, non-interrupted, cast-in-place "flawless", (i.e. no joints), concrete structures which have superior performance characteristics to piecewise construction, using discretely formed elements. Slip forming relies on the quick-setting properties of concrete, and requires a balance between quick-setting capacity and workability. Concrete needs to be workable enough to be placed into the form and consolidated, (via vibration), yet quick-setting enough to emerge from the form with strength (also "self supporting strength" or "green strength"). This green strength is needed because the freshly set concrete must not only permit the form to "slip" upwards/forward, but also support the freshly poured concrete above it ("vertical slip forming") and/or the freshly poured concrete in front of it ("horizontal slip forming").

In vertical slip forming, the concrete form may be surrounded by a platform on which workers stand, placing steel reinforcing rods into the concrete and ensuring a smooth pour. Together, the concrete form and working platform are raised by means of hydraulic jacks. Generally, the slip-form rises at a rate which permits the concrete to harden (develop green strength) by the time it emerges from the bottom of the form. In horizontal slip forming for pavement and traffic separation walls, concrete is laid down, vibrated, worked, and settled in place, while the form itself slowly moves ahead. This method was initially devised and utilized in Interstate Highway construction initiated by the Eisenhower administration during the 1950s.

The following is a representative (and not exhaustive) review of the prior art in this field:

U.S. Pat. No. 3,792,133 (to Goughnour issued Feb. 12, 1974) describes a method and an apparatus for concrete slip forming a highway barrier wall of varying transverse cross-sectional configuration for accommodating different grade levels on opposite sides of the wall, and wherein variations in the wall cross-sectional configuration may be readily accomplished during wall formation without requiring stopping, realignment or other interruptions in the screed movement during wall forming.

U.S. Pat. No. 4,266,917 (to Godbersen issued Mar. 12, 1981) describes a method for the efficient slip forming of highway median barrier walls of differing size (adjustable height) and shape having any arrangement of linear and curved sections and while the machine is being advanced in a single direction. The lateral adjustability of opposite side walls of the form, relative to the top wall, permits the use of the side walls with top walls of varying widths. The relative vertical adjustment of the top wall and side walls provides for a wide variation in the vertical height of a barrier wall particularly where a glare shield is to be formed on the barrier wall top surface. The slip forming of the glare shield takes place simultaneously and continuously with the slip forming of the barrier wall and over any selected portion of the wall while the machine is being advanced in a single direction. At any adjusted position of the slip form, the skirt member associated with each side wall is adjustable to prevent any flow of concrete from between the ground or highway surface and the form.

U.S. Pat. No. 4,084,928 (to Petersik issued Apr. 18, 1978) describes an improved barrier forming apparatus and method whereby a barrier is formed continuously over a surface, the barrier having continuous reinforcing rods extending the length of the barrier and having cage reinforced standard supports at predetermined intervals along the length of the barrier. The Petersik improved barrier forming assembly comprising a concrete forming member having a form cavity extending there through; a concrete passing member having a concrete delivery opening for passing concrete or the like to the form cavity; and a positioning assembly comprising a support shaft and a door member pivotally supported at a forward end of the concrete forming member, the barrier being extrudable continuously via the form cavity from a rearward end of the concrete forming member. The door member selectively is positionable to partially seal the form cavity at the forward end of the concrete forming member and has rod clearance channels through which the reinforcing rods pass through the door member into the form cavity when the door member is so positioned to seal the form cavity. The rod clearance channels permit the door member to pass the reinforcing rods to open the form cavity at the forward end of the concrete forming member to allow the free passage of the barrier forming assembly over the cage reinforced standard supports.

U.S. Pat. No. 5,290,492 (to Belarde, issued May 1, 1994) describes a system for continuously forming a concrete structure (a) having a predetermined cross-sectional configuration, (b) which extends along an elongate path, and (c) includes an outer surface having a textured pattern comprising concave or convex portions which extend other than just parallel to the elongate path. The system includes a frame, a first form assembly, a second form assembly, a drive system, and a support assembly.

As is evident from the above, there are number of alternatives for the slip forming of structures for use in road and bridge construction. The numerous alternative systems have their proponents and their detractors. In the context of selection of the more appropriate and efficient system, for example, for construction of retainer/barrier walls and/or glare shield concrete structures, time is money and often is reflected in the bidding process. More specifically, the bid letting on highway construction projects routinely include both penalty provisions for tardy completion and/or bonus payments for early completion. Accordingly, efficiencies which advance project completion, generally translate into cost saving. Thus, there is continuing efforts to automate, where possible, the fabrication of structural concrete components in highway construction; and, to standardize the process for the fabrication of roadway components and thereby simplify the bid letting on such projects, particularly federally funded highway construction projects.

Up to now, the standard or generally accepted techniques for the fabrication of bridge coping for an overpass on the highway, have required either the use of a pre-cast coping element (fabricated off-site), and/or the manual casting of a coping on-site, utilizing traditional forms and concrete casting techniques. In the case of a pre-cast concrete coping element, the road bed of the overpass requires special preparation since the pre-cast element does not readily conform to the angle of incline or grade of a ramp or overpass and, therefore, imperfectly abut one another upon placement on the incline of the bridge overpass. Accordingly, additional installation expense is required to insure the connection of abutting pre-cast copings to one another to insure the formation of a unitary coherent structure.

Alternatively, the on-site casting of an overpass/bridge coping, using the a manual process for forming the coping, specifically, traditional forms and concrete casting techniques, is preferably to the pre-cast coping, because the resulting coping is structurally continuous, and better conforms to the incline/grade of the ramp or overpass. Notwithstanding, the on-site casting of a bridge coping, by traditional concrete casting techniques, is very labor intensive and does not, without an inordinate amount of man power, lend itself to rapid fabrication and accelerated completion schedules. In each of the foregoing alternatives, the coping is formed with extending rebars for the later integration of the coping into a road bed pad and/or the attachment to a retaining wall, which can be later formed on the top of the coping.

Accordingly, there continues to exist the need for improved slip-mold design to both simplify the on-site fabrication of a bridge coping, minimize the manual labor requirements, permit/accommodate accelerated construction schedules, and yet produces a structure which is both coherent (e.g. monolithic structure), and faithfully conforms to the angle of incline or grade of a road overpass, without additional extensive on-site preparation.

OBJECTIVES OF THIS INVENTION

It is the object of this invention to remedy the above, as well as related deficiencies, in the prior art.

More specifically, it is the principle object of this invention to provide an improved slip-mold for forming a monolithic, concrete structure having both partially embedded, rebar reinforcement and partially exposed (extending) rebars.

It is another object of this invention to provide an improved slip-mold for forming a monolithic, concrete structure, which includes a formed bridge coping, having exposed rebars.

It is yet another of object of this invention to provide an improved system and method for slip forming a monolithic, concrete structure, which includes a formed bridge coping having both partially embedded and partially exposed (extending) exposed rebars.

Additional objects of this invention include a tunnel mold assembly equipped slip forming machine for slip forming a monolithic concrete structure with exposed rebars; and, a tunnel mold for use in the slip forming of a monolithic concrete structure with exposed rebars.

SUMMARY OF THE INVENTION

The above and related objects are achieved by providing a slip-mold having a housing defining (a) a concrete hopper with means for distribution of quick set concrete within said hopper, (b) a mold cavity, and (c) at least one tunnel, in communication with said mold cavity, and extending through said housing from the leading to the trailing end of said housing. The tunnel through the housing is of sufficient height and width, and positioned within said mold housing, to permit rebars, extending from an iron work array, to pass through said mold cavity without becoming embedded in concrete, concurrent with the formation of a slip formed concrete structure on a portion of said iron work array.

In one of the preferred embodiments of this invention, the slip mold comprises a mold cavity for forming a coping for integration of an MSE wall and a road bed. In this preferred embodiment of the invention, the slip-mold includes a series of vibrators positioned within the mold cavity for consolidation of the concrete within the mold cavity, as the slip-mold is progressively advanced over an iron work array. In this embodiment of the invention, the vibrators are positioned to insure consolidation of the concrete within the mold at the margins of the slip formed concrete structure, and proximate to the tunnels through the housing. In each instance, the vibrators provide for a compaction of the concrete within the slip-mold, and, thus, both an enhanced (smooth) finish to the surface of the concrete structure, and improved adhesion of the concrete to the iron word array embedded therein.

The consolidation of the unset concrete within the mold cavity, proximate to the tunnels through the slip-mold, both increases the density of the concrete at the base of these tunnels, and tends to force the concrete into the tunnels from the mold cavity. In order to minimize the migration of unset concrete into the tunnels from the mold cavity, prior to the consolidation of the concrete, a series of fins are provided, which extend downward from each defining wall of the tunnels, into the unconsolidated concrete in mold cavity. The depth of penetration of the fins into the unconsolidated concrete in the mold cavity is related to the relative time it takes for the concrete to begin to consolidate, the proximity of the vibrators to the tunnels in the mold and the rate of movement of the tunnel mold over the iron work array. The design of these fins, (e.g. depth of penetration of the fin, and the length), can be estimated fairly accurately based upon the foregoing factors. The final design configuration for these fins is also based upon the ambient conditions prevalent at the time of the slip forming. The final design configuration selected is effective to inhibit the migration of unconsolidated concrete into each of the tunnels of the mold, thereby prevents concrete from covering the rebars which extend from the iron work array into these tunnels. Accordingly, the rebars passing through these tunnels in the mold cavity, remain essentially concrete free as the slip mold progressively advances over the iron work array during the slip forming process.

In the preferred embodiments of this invention, one or more of the vibrators can extend into the mold cavity to a depth sufficient to contact the iron work array, as the tunnel mold is progressively advanced over such array. In this preferred embodiment of the invention, the vibrators are maintained at an inclined angle, relative to the iron work array so as to pass over the iron work without become entangled in the array. At least some of these vibrators are strategically positioned at the lateral margins of the mold cavity to insure compaction of concrete at these exposed surfaces of the slip formed structure and a smooth (dense) surface appearance.

DESCRIPTION OF THE INVENTION INCLUDING PREFERRED EMBODIMENTS

Figure 1:
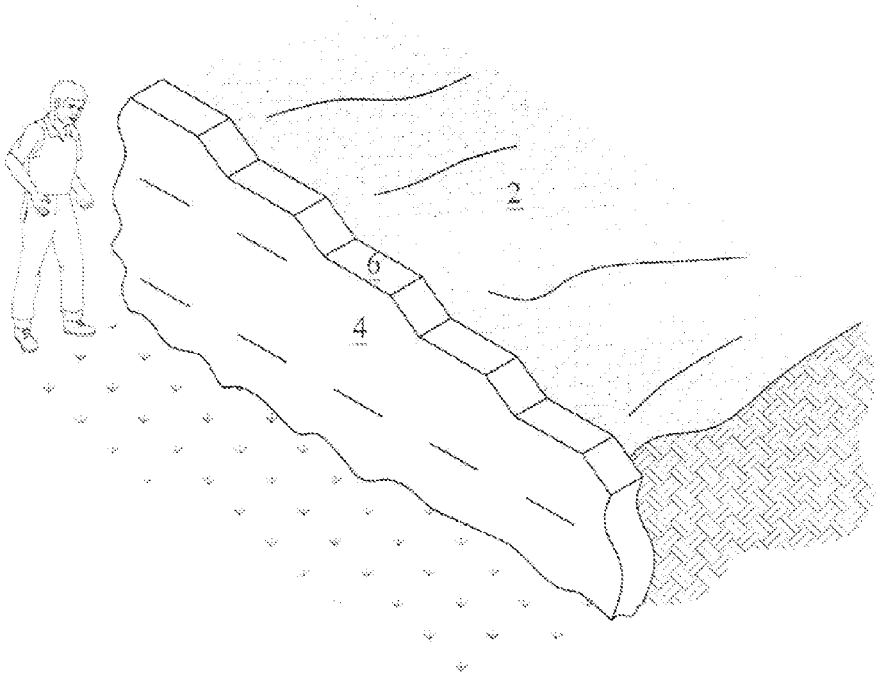
FIG. 1 depicts a perspective view of an inclined road bed, which has yet to be prepared for the addition of a concrete coping or concrete road pad.

As understood within the context of this invention, the following terms and phrases are intended to have the following meaning unless otherwise indicated.

Glossary of Terms

The phrase "slip forming", or "horizontal slip forming", is intended, and used herein, to describe a construction method in which concrete is poured into a continuously moving form ("slip mold"). Slip forming is used for tall structures (such as bridges, towers, buildings, and dams), as well as horizontal structures, such as roadways. Slip forming enables continuous, non-interrupted, cast-in-place "flawless" (i.e. no joints) concrete structures, which have superior performance characteristics to piecewise construction, using discrete form elements. Slip forming relies on the quick-setting properties of concrete, and requires a balance between quick-setting capacity and workability. Concrete needs to be workable enough to be placed into the form and consolidated (via vibration), yet quick-setting enough to emerge from the form with strength, (also "green strength"), sufficient to be self-supporting because the freshly set concrete must not only permit the form to "slip" forward but also support the freshly poured concrete which now abuts it, as the form continues to move forward.

The phrase "slip mold" is intended and used herein, to describe a mold used in the slip forming of a continuous concrete structure (preferably reinforced with iron work) with quick setting concrete. The slip mold is mounted on a movable conveyance which positions the slip mold over an essentially continuous reinforcing concrete cage. Concrete is poured into the mold, while the mold is progressively advance over the cage.

The phrase "tunnel mold" is intended, and used herein, to describe a unique slip-mold having a one or more tunnels or s through the mold. Each of these tunnels or channels has an open end in communication with the mold cavity, and is of a sufficient height to accommodate the passage of concrete free rebars, which extend into these tunnels or channels from within the mold cavity, as they pass through such tunnels or channels. The slip formed structure which emerges from the tunnel mold has both embedded rebars and concrete free rebars.

The term "rebar" (short for "reinforcing bar"), is intended, and used herein, to describe a steel bar that is commonly used as a tensioning device in reinforced concrete, and in reinforced masonry structures, to strengthen and hold the concrete in compression. It is usually in the form of carbon steel bars or wires, and the surfaces may be deformed for a better bond with the concrete.

The term "coping" or "bridge coping" is intended, and used herein, to describe and connote the structural element which is affixed and preferably integral with the top of a retaining wall, (e.g. MSE retaining wall), of an elevated roadway. Within the context of this invention, "coping" and "bridge coping" are fabricated by the improved process of this invention, and have rebars both extending from within and partially embedded within the slip formed coping. The slip formed coping prepared in accordance with the process of this invention is, thus, unique in terms of its fabrication history.

The abbreviation "MSE" is intended, and used herein, to describe Mechanically Stabilized Earth, constructed with artificial reinforcing. MSE walls stabilize unstable slopes and retain the soil on steep slopes and under crest loads. The wall face is often of precast, segmental blocks, panels or geocells, that can tolerate some differential movement. The walls are in-filled with granular soil, with or without reinforcement, while retaining the backfill soil. Reinforced walls utilize horizontal layers typically of geogrids The reinforced soil mass, along with the facing, forms the wall.

The phrase "road pad' is intended, and used herein, to describe a slip formed concrete slab, which is preferably formed concurrent with the bridge coping. The road pad is used to delineate the lateral margins of the road bed, and is subsequently integral with the road bed.

Highway Construction Environment

The tunnel mold concept of this invention is illustrated within the context of the slip forming of reinforced concrete structure for road, bridge, and highway barrier construction. Accordingly, the following description and accompanying illustration depict the tunnel mold and slip forming concept, as applicable to this road, bridge and highway construction environment. In the description of the preferred embodiments of this invention, as illustrated in accompanying patent drawings, where an element or feature in one or more Figures is common to more than one of the accompanying patent drawings, it is assigned the same reference numeral for ease of understanding and simplicity of expression.

FIG. 1 is a perspective view of an inclined road bed (2) for an overpass. As is evident from this illustration, the angle of incline (ascent), and decline (descent), of the road bed can vary with the grade, and, thus, the preferred method for the fabrication of structural components associated with such inclined road bed are best resolved with on-site fabrication of the structural bridge and road elements. Within the context of this invention, the focus is upon the integration of the structural components for a roadway by means which eliminate intensive manual labor, and provide for the sequential formation of bridge and overpass components by means of slip forming. The road bed (2) shown in this FIG. 2 has an incline which has been stabilized by MSE retaining wall (4). The MSE retaining wall (4) shown in FIG. 2 has an unfinished top edge (6), which needs to be integrated into the road bed (2). This integration typically requires the formation of a coping or a comparable structural element, along the unfinished top edge (6) of the MSE retaining wall (4), which, in turn, is further integrated into the finish road bed (not shown).

Figure 2:
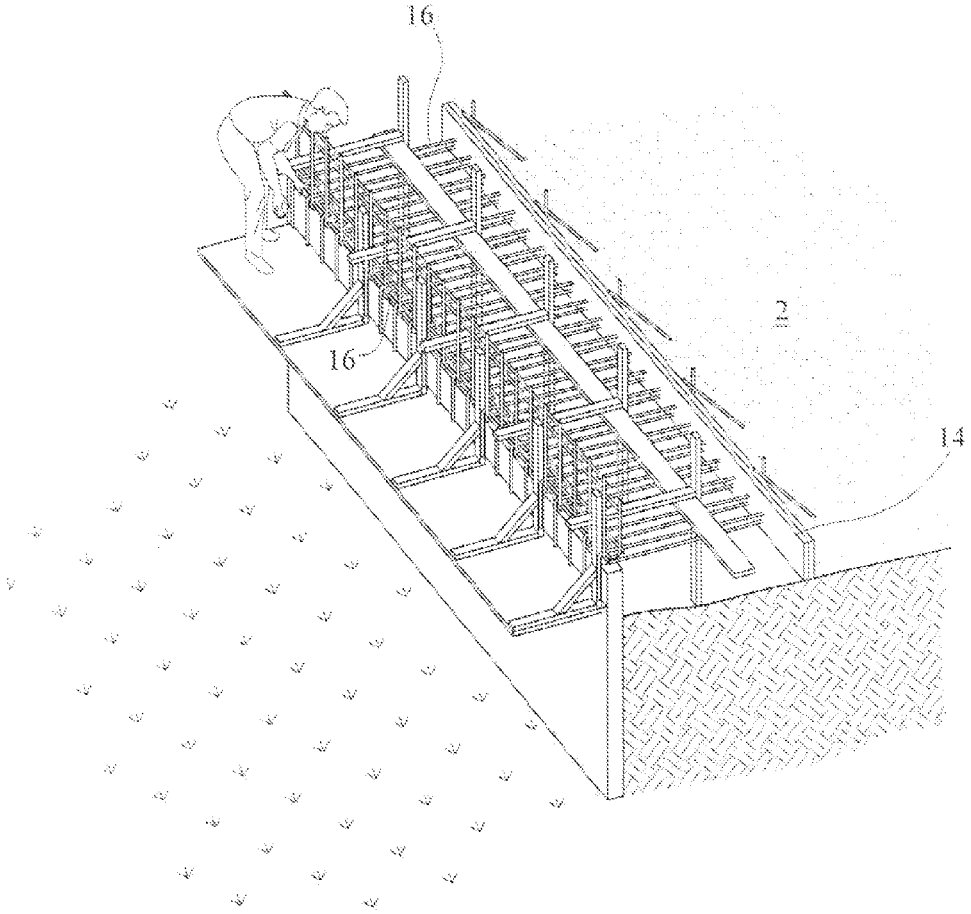
FIG. 2 depicts a perspective view of the custom fabricated forms used in the on-site framing of a coping and road bed pad preliminary to the manual casting of a coping and road bed pad by traditional concrete casting techniques.

FIG. 2 is a perspective view of the traditional, manual on-site preparation for casting of a bridge coping and road pad onto a road bed (2) by conventional concrete casting techniques. In the manual on-site casting of a bridge coping and road pad, extensive manual preparation is required to initially frame a series of forms (14). These forms (14) are used to confine a concrete pour onto an array of iron work or reinforcing steel (16). After the cast concrete sets up, the workers thereafter breakdown the forms; and, this manual process repeated for an additional length of coping, until the job is completed. In a typical road construction environment, this process is labor intensive, time consuming, inefficient and very slow because the typical road crew can only fabricate about 40 to 50 feet of traditionally cast product per day. Obviously, the employment of additional manpower on the job will advance the construction schedule somewhat, but be prohibitively expensive and uncompetitive.

Figure 3A:
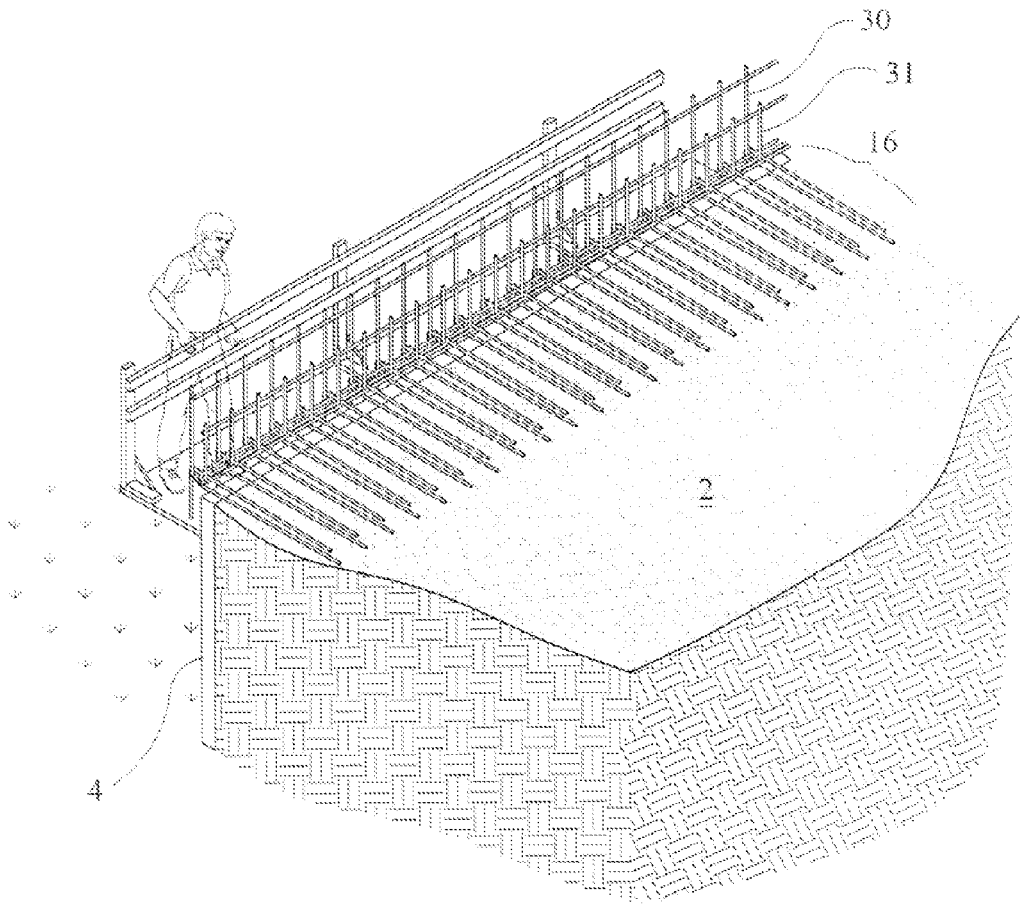
FIG. 3(A) depicts a perspective view of the iron work array on an inclined road bed, prior to the concurrent slip forming of a bridge coping and road bed pad.

FIG. 3(A) depicts a perspective view of the layout of the iron work array (16) for the slip forming of coping and road bed pad on a similar inclined road bed (2) as in FIG. 2. As is evident, the preparation for the slip forming of a coping a road bed pad does not require the use of the tradition series of forms (14). It is emphasized, that the placement of the ironwork array (16) is arrange along the road bed (2) proximate to the MSE retaining wall (4) without structure defining elements (forms). The ironwork array (16) can, and is often fabricated on-site; and, its placement determined by a series of survey or/reference lines (not shown).

Figure 3B:
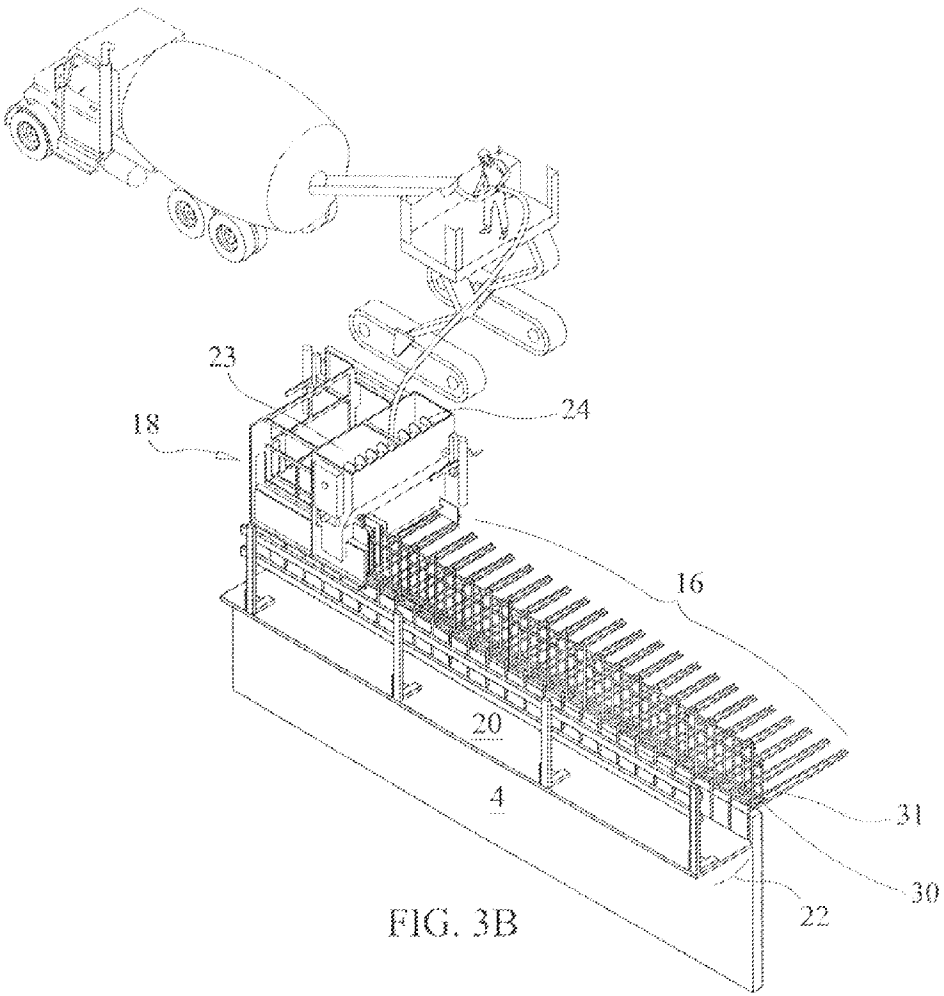
FIG. 3(B) depicts a perspective view of the tunnel mold assembly of this invention, in relation to the iron work array of FIG. 3(A).

FIG. 3(B) depicts placement of a tunnel mold (18), preliminary to the slip forming of a coping and road bed pad upon the ironwork array (16) of FIG. 3A. Fig. (B) shows the iron work array (16), in respect to the MSE retaining wall (4), and a platform (20) which has been erected along the outside (exposed side) of MSE retaining wall (4) to allow for worker oversight of the slip forming process, and to provide a support (22) for a coping along the top of the MSE retaining wall (4). More specifically, the platform (20) is positioned, relative to the iron work array (16), and to the top of the MSE retaining wall (4), so as to provide a base for a coping, which is to extend over the top of the MSE retaining wall (4). In this FIG. 3(B), the tunnel mold (18) is shown to have an open hopper (25) positioned above a mold cavity (23) of the tunnel mold (18).

Figure 3C:
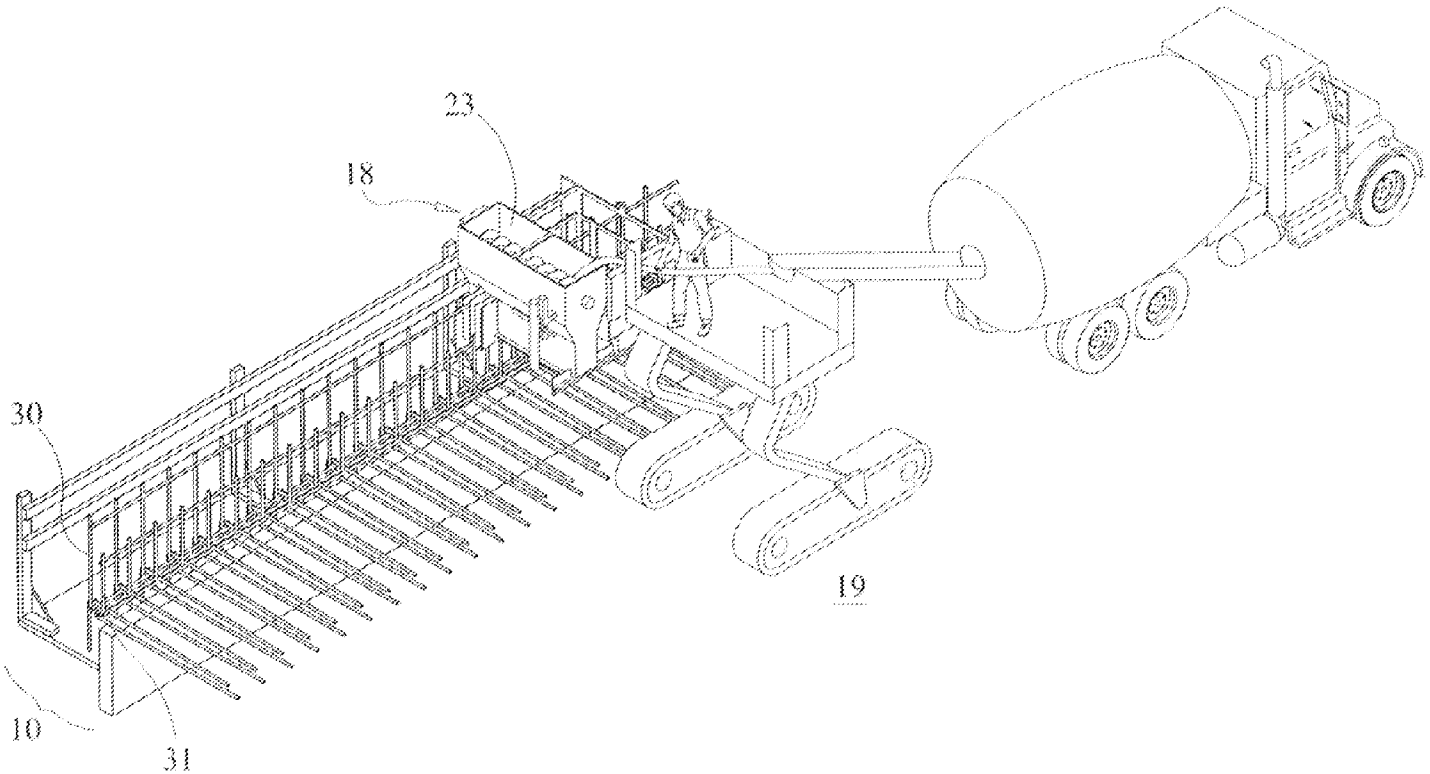
FIG. 3(C) depicts slip forming machinery of this invention in relation to an iron work array of FIG. 3(A).

FIG. 3(C) depicts the tunnel mold (18) in combination with slip forming support assembly (19) typically associated therewith. In FIG. 3(C), ready mix concrete is conveyed from a cement mixer to a slip forming support assembly (19) mounted on a transport. A workman is shown dispensing the relatively fluid concrete mix into the hopper (25) of the tunnel mold (18). The assembly includes both well-know means for guidance of the assembly relative to the iron work arrays; and, for modulation of the speed of the assembly.

Figure 4A:
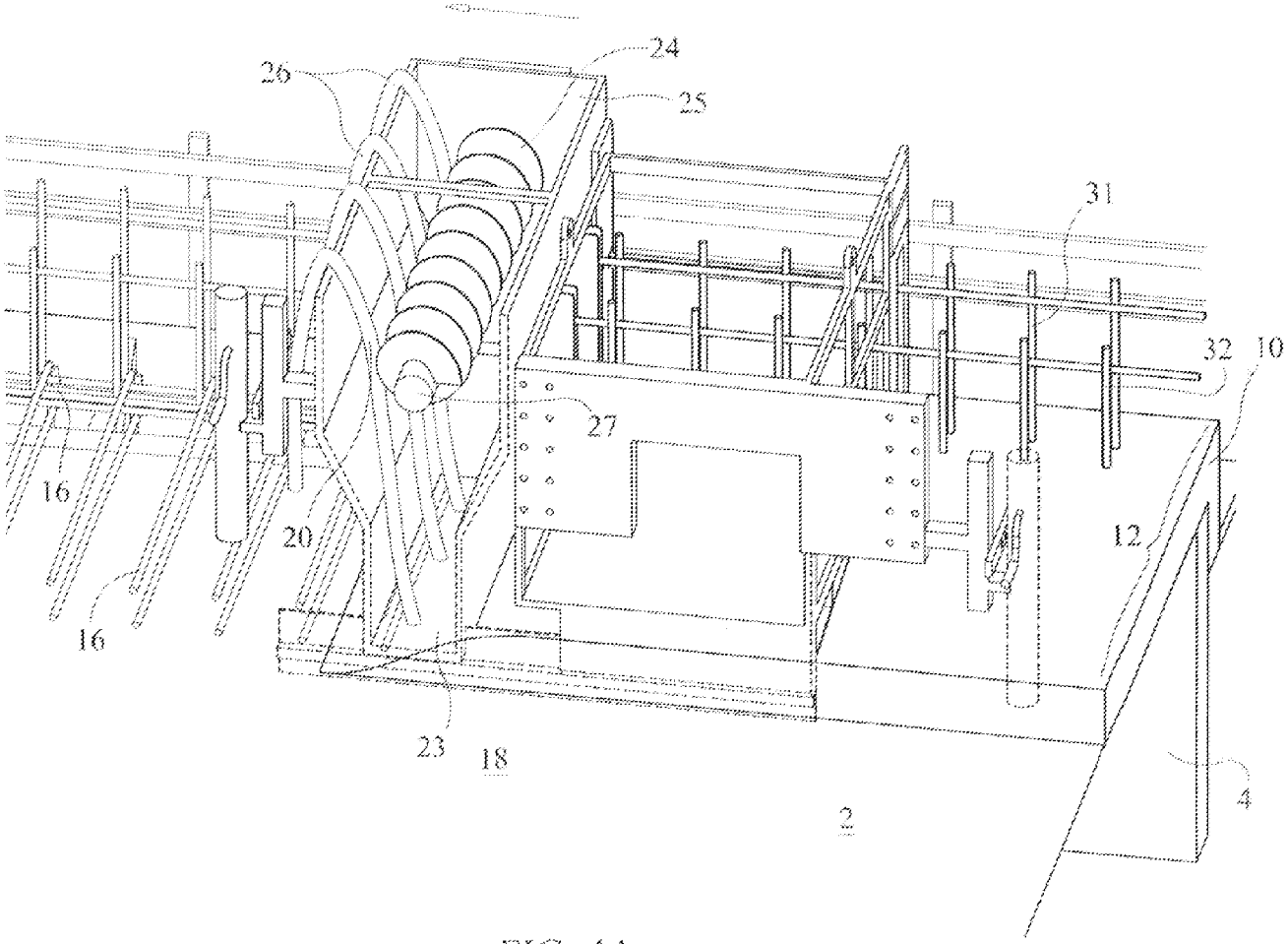
FIG. 4(A) is an enlarged view, (in partial cut away), of the tunnel mold of FIGS. 3(B) & (C), when viewed from the side of the tunnel proximate to the road bed (2).

FIG. 4 (A) is an enlarged view, (in partial cut away), of the tunnel mold (18) of FIGS. 3(B) & (C), when viewed from the side of the tunnel mold (18) proximate to the road bed (2). In FIG. 4(A), the auger (24) is disposed within a hopper (25) positioned above a mold cavity (23) of the tunnel mold (18). A series vibrators (26) extend into the tunnel mold (18), through the hopper (25) and down into the mold cavity (23). Upon the dispensing of a ready mix concrete (not shown) into the hopper (25) of the tunnel mold (18), the concrete gradually fills the hopper (25), and the mold cavity (23), until it completely covers the auger (24). The auger (24) is driven by a drive motor (not shown), which rotates an auger drive shaft (27), and thereby effects rotation of the auger and distribution of the concrete across the width the hopper (25) and mold cavity (23). In practice, and during the operation of the slip forming process, the tunnel mold (18) is progressively advanced over the ironwork array (16) of FIG. 3A (from left to right), as a slip formed, concrete coping (10) and a road bed pad (12), are formed upon the iron work array (16). A series of vibrators (26) consolidate the concrete within the mold cavity (23) of tunnel mold assembly (18) and thereby compact the concrete and eliminate any voids or lack of continuity within the resultant slip formed structure. This consolidation of the concrete in the mold cavity (23) is essential to the green strength of the concrete coping (10) and a road bed pad (12); and, a prerequisite to the continuous forward movement (slipping) of the tunnel mold assembly from the formed concrete coping (10) and a road bed pad (12), over the iron work array.

Figure 4B:
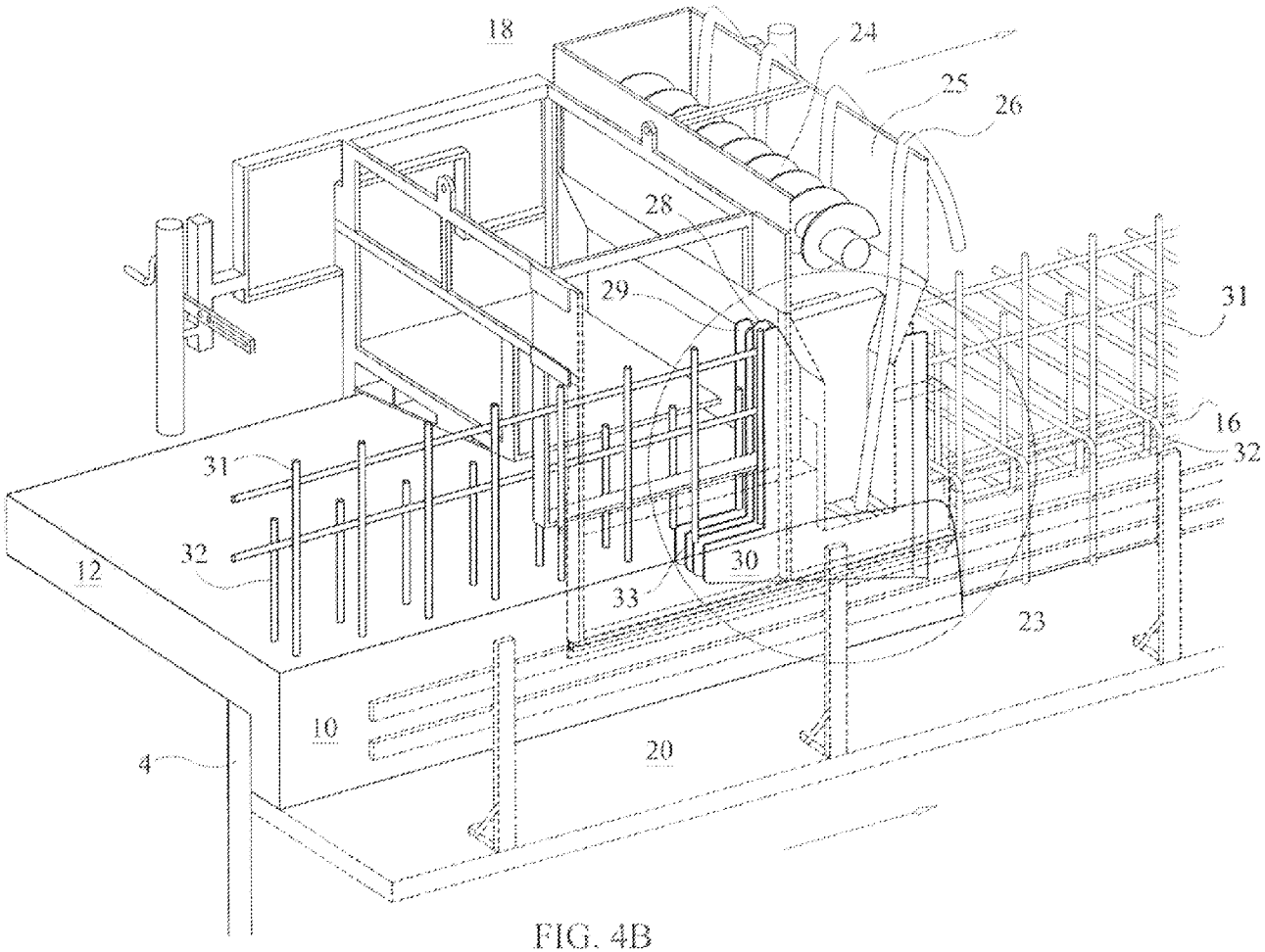
FIG. 4(B) is an enlarged view, (in partial cut away), of the tunnel of FIGS. 3(B) & (C).), when viewed from coping side of the tunnel mold.

FIG. 4(B) is an enlarged view, (in partial cut away), of the tunnel mold (18) of FIGS. 3(B) & (C).), when viewed from coping side of the tunnel mold. In FIG. 4(B), the tunnel mold (18) is shown to have two open slots or tunnel (28, 29), for accommodating the passage a pair of rebars (30, 31), through the tunnel mold (18). The design and engineering of the tunnels enables rebars (30, 31), to pass through the tunnel mold (18) during the slip forming of a bridge coping, and yet remain essentially concrete free. This is accomplished by designing each of the tunnels, more specifically, accessories to the tunnels, to inhibit the flow of concrete from the mold cavity into each of the tunnels. More specifically, each of tunnels (28, 29) are further provided with fins (32, 33), which extend from tunnels (28, 29), into the concrete in the mold cavity (23) concurrent with the slip forming of the coping (10), to prevent/minimizing the flow of unconsolidated concrete from the mold cavity (23) into tunnels (28, 29) are further provided with fins (32, 33), which extend from tunnels (28, 29) and thereby permitting the formation of a coping (10) with exposed, concrete free, rebars (30, 31).

Figure 4C:
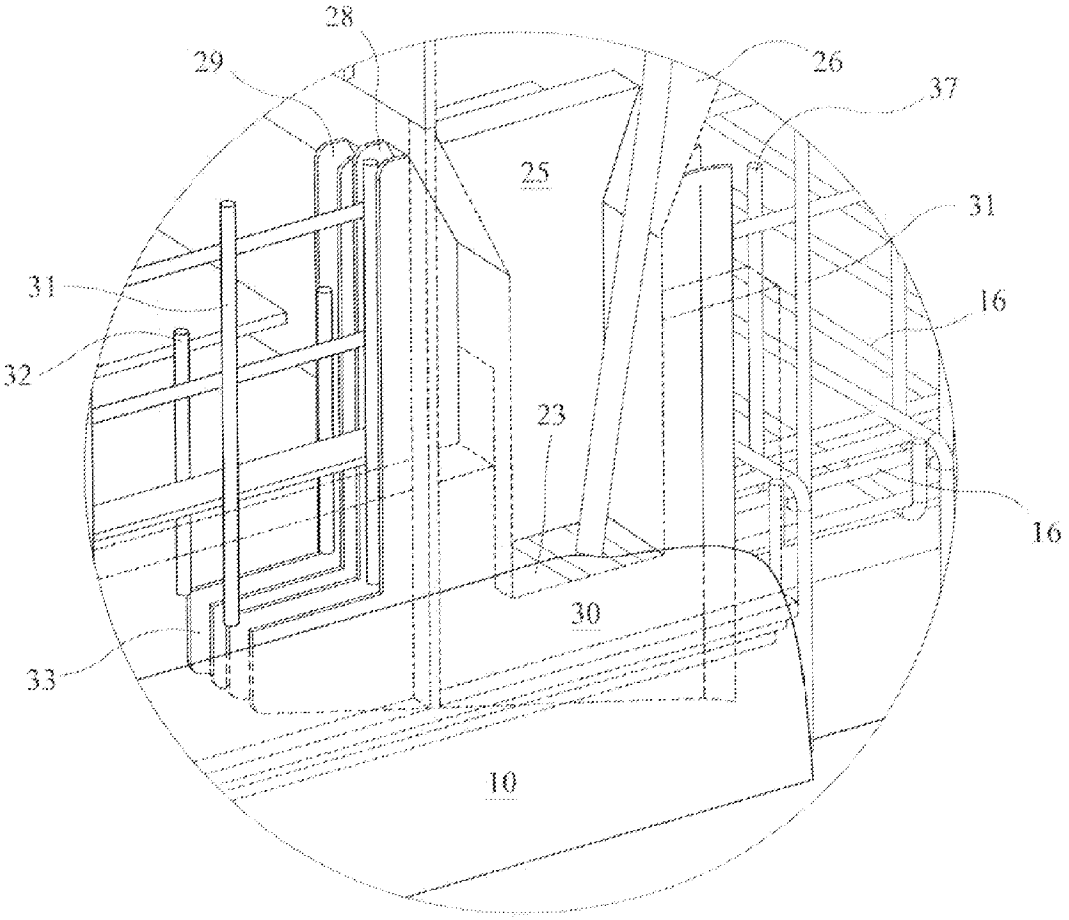
FIG. 4(C) depicts an isolated an enlarged view of with) of FIG. 4(B).

FIG. 4(C) depicts an isolated and enlarged view of the fins (32, 33) of FIG. 4(B). In this FIG. 4(B), the fins (32, 33) extend from the tunnels (28, 29) into the mold cavity (23) and, thus, effectively inhibit the unconsolidated concrete from flowing in the tunnels. The fins (32, 33) in this FIG. 4(B) are tapered, and, thus, extend more deeply into the formed coping (10) at the forward or leading edge of the mold tunnel (28, 29). In this FIG. 4(C), the vibrator (26) is proximate to the tunnels (28, 29), thereby consolidating the concrete proximate to these tunnels (28, 29). This consolidation compacts the concrete proximate to the tunnels (28, 29), and, this compacted concrete further impedes the flow of concrete from the mold cavity (32) into the tunnels (28, 29). Accordingly, when the tunnel mold (18) advances forward over the iron work array (16), only the iron work array, within the mold cavity (23), is embedded in concrete, whereas the rebars (31, 32), which pass through the channels (28, 29) remain essentially concrete free. As the tunnel mold (18) moves progressively forward over the iron work array (16), the fins (32, 33) are withdrawn from the coping by the advancing tunnel mold (18), and the concrete within the mold cavity (23) recedes into the fin tracks in the slip formed coping.

Figure 5A:
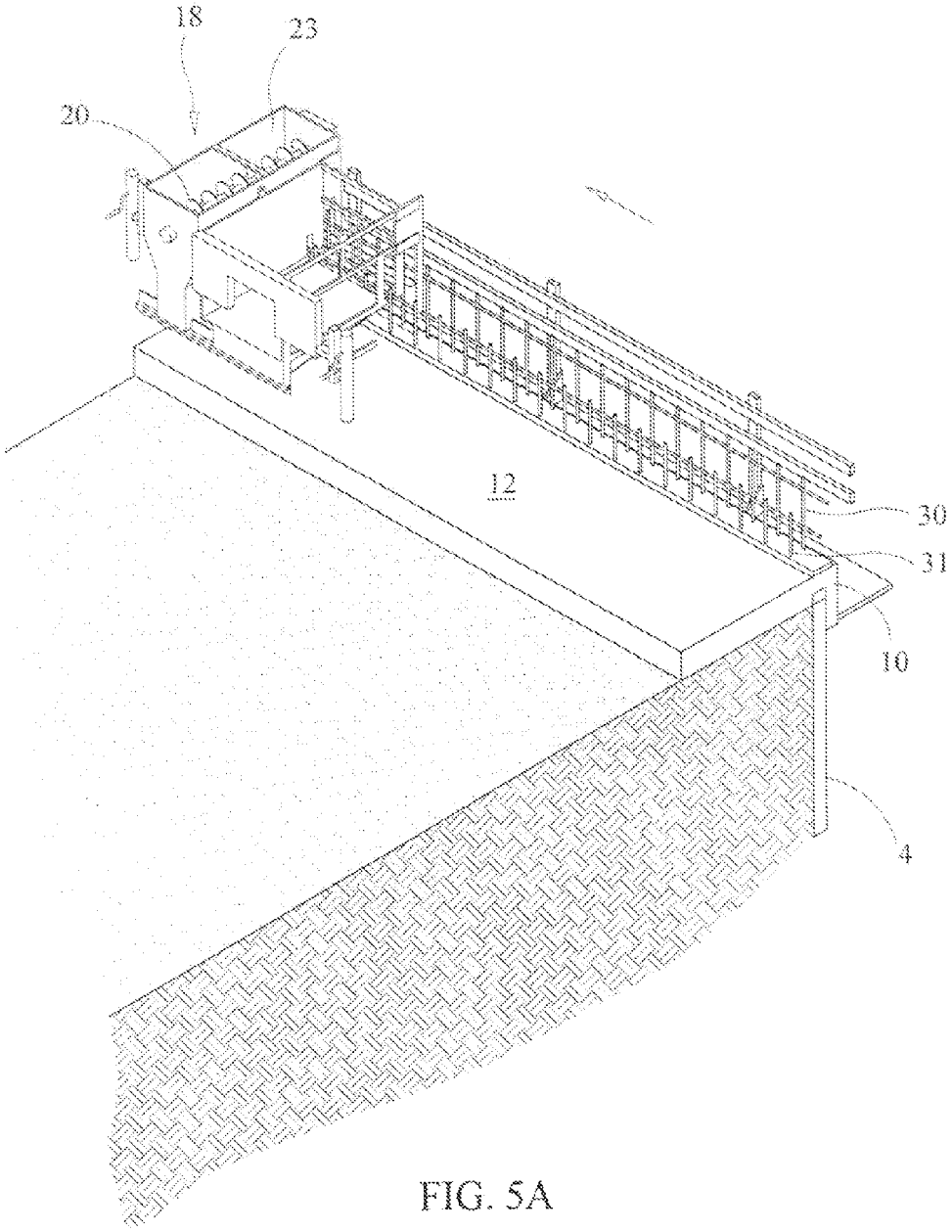
FIG. 5(A) depicts a perspective view of a tunnel mold assembly and slip formed bridge coping and road bed pad, when viewed from the rear of the tunnel mold.

FIG. 5(A) depicts a coping (10) and road pad (12), which have been formed with the tunnel mold (10) of FIG. 4(A) to FIG. 4(C), in accordance the slip forming system and process of this invention. As is evident in FIG. 5(A), the coping (10) and road pad (12) have been slip formed as a monolithic structure; and, the coping (10) fully engages the top of the MSE retaining wall (4), so as to mechanically couple the MSE retaining wall (4) to the road (road pad (12)). The coping (10) includes extending rebars (30, 31) which can be used to further integrate the coping (10) with other structural road elements.

Figure 5B:
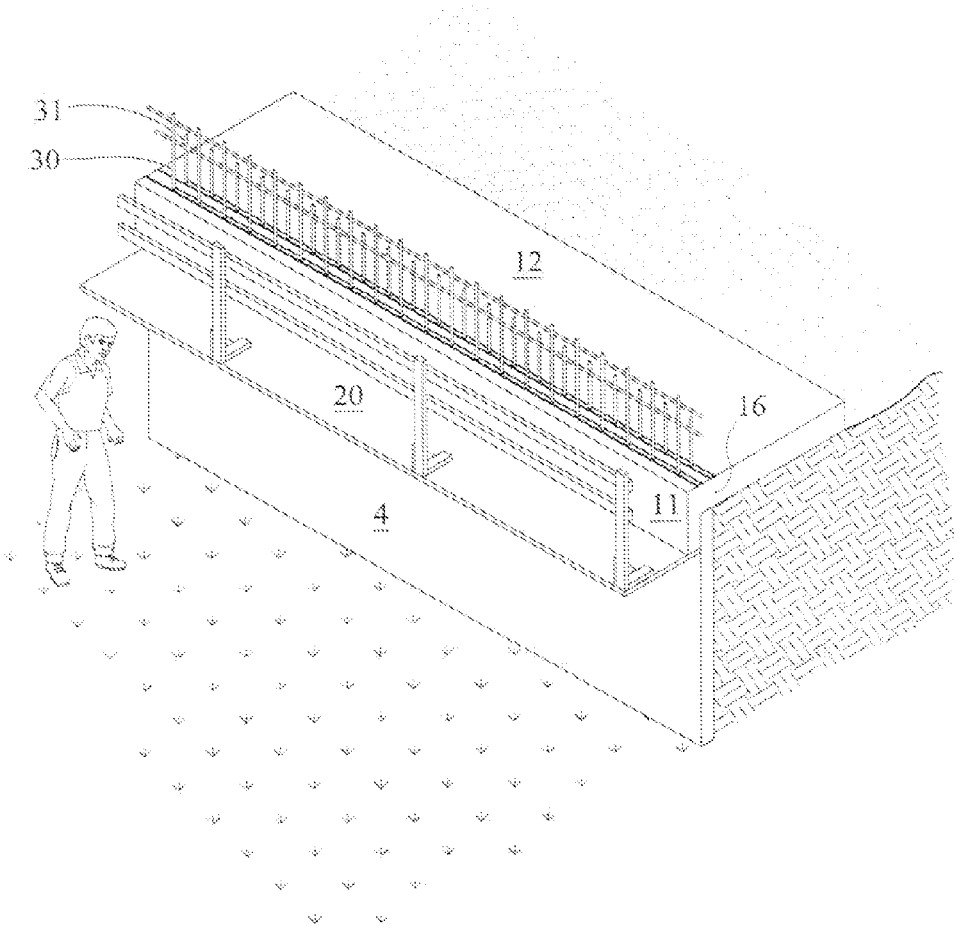
FIG. 5(B) depicts a perspective view of a slip formed bridge coping and road bed pad, when viewed from side of an MSE retaining wall.

FIG. 5(B) depicts a slip formed coping (10) and road pad (12), when viewed from the side of the MSE retaining wall (4). In FIG. 5(B), the coping (10) extends over the top and down the outside of the MSE retaining wall (4), to the platform (20), which had been constructed along the side of the MSE retaining wall (4). In this FIG. 5(B), the platform (20) is shown to have served as a support/form for the base of vertical extension (11) of the coping (10), and thereby, the position of the platform (20) relative to the top of the MSE retaining wall (4), defines the length of the vertical extension (11) of the coping (10) proximate to MSE retaining wall (4).

Figure 6A:
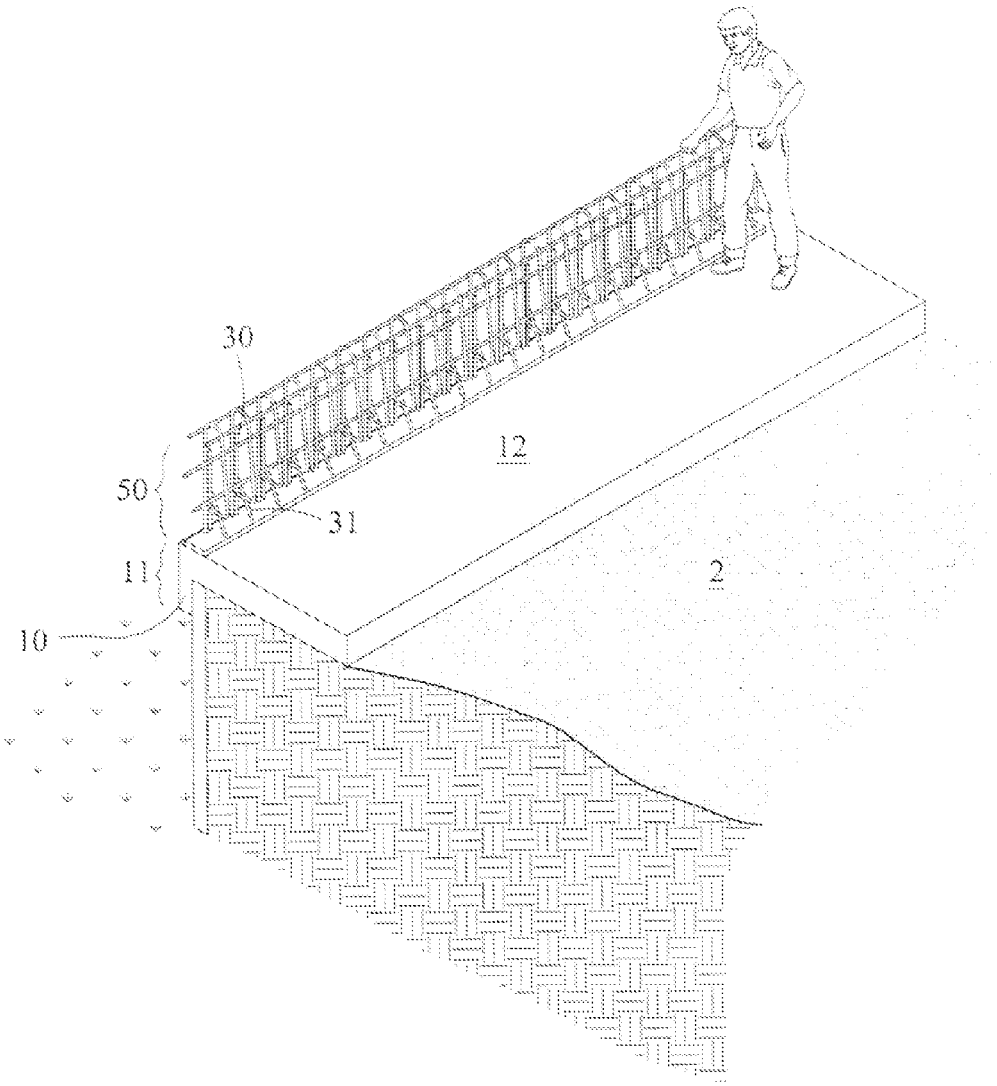
FIG. 6(A) depicts a perspective view of a slip formed bridge coping and road bed pad wherein the extended rebars are physically joined to additional rebars.

FIG. 6A depicts a perspective view of the layout of an iron work array (50) for a retaining wall/barrier wall which has been placed on top of the slip formed bridge coping illustrated in FIG. 5(A) and FIG. 5(B). The extending rebars (30, 31), from the slip formed coping (10) and road pad (12), having which have been physically connected to iron work array (50) for a retaining wall/barrier wall.

Figure 6B:
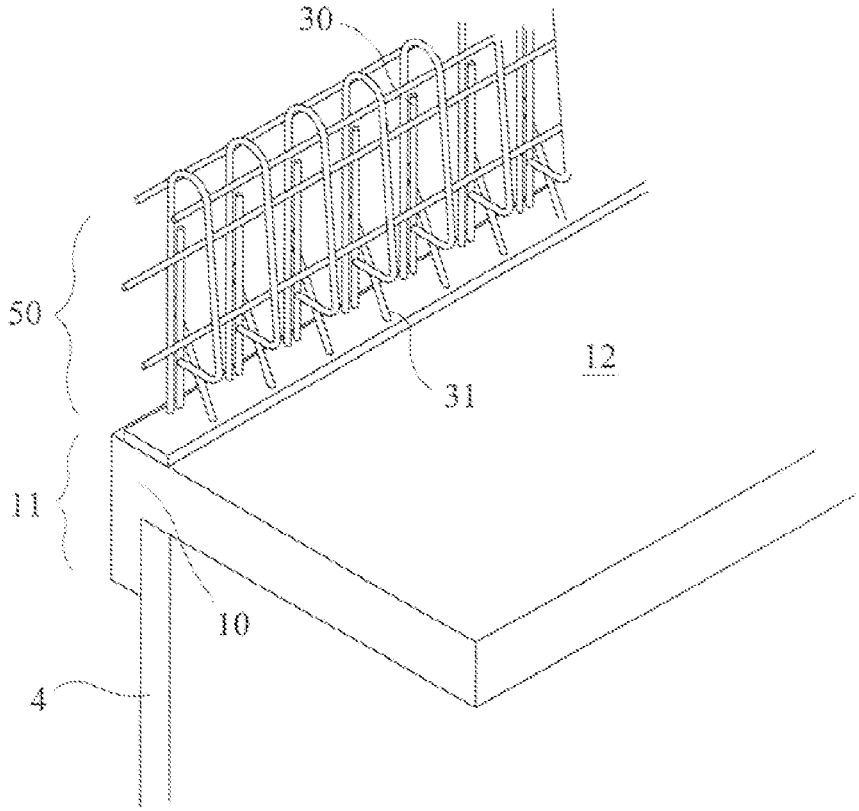
FIG. 6(B) is an enlarged view the extended rebars, from a slip formed bridge coping, physically joined to additional rebars

FIG. 6B is an enlarged view of the extending rebars (30, 31) which have been physically connected to additional reinforcing steel rods. In order to accommodate their physical connection, rebar (31) has been bent prior to the connection to additional reinforcing steel rods. Accordingly, upon slip forming of a retaining wall/barrier, it shall be structurally reinforced with both exposed rebars (30, 31) from the coping (10) and an additional iron work array (50) intended for such reinforcement. Thus, the retaining wall/barrier wall, once formed, shall be integrated into the slip formed coping (10).

The foregoing invention has been described in reference to a number of the preferred embodiments of this tunnel mold, system and method for the in situ fabrication of concrete structures for highway and bridge construction; and, the resultant concrete structures formed in this process. Both time and space does not permit inclusion all of the potential applications of this process for the formation of monolithic reinforced structures, nor is the invention limited to the concrete and/or rebar reinforcement. Clearly, this process has potential application to the slip formation of reinforced structural shapes having both an embedded reinforcing member, and an exposed component of such reinforcing member. Thus, the scope of this invention is not limited by the preferred embodiments thereof, which has been illustrated and described, but rather defined in the following claims.

What is claimed is:

1. In a process for forming concrete structural components for road and bridge construction, wherein the resultant concrete structural components have exposed rebars for the later integration with additional concrete and/or mechanical structural elements, said additional concrete and/or mechanical structural elements selected from the group consisting essentially of sound walls, barricades, guard rails and any combination thereof, wherein the improvement comprises:

A. Providing an iron work array wherein said iron work array comprises both (1) rebars for embedding within, and reinforcing, a first concrete highway structure and (2) rebars for extending from within said first concrete highway structure, for integration within and reinforcing a second concrete highway structure, to be formed at a later time;

B. Providing a machine assembly having a tunnel mold comprising

1) A mold housing including a) A hopper, a mold cavity and one or more channels, i. Said hopper comprising a means for receiving concrete and directing flow of said concrete into said mold cavity, ii. Said mold cavity defining a shape of concrete structure to be formed on an iron work array, and iii. At least one channel comprising an elongate opening extending through said housing, from front to back of said housing, and into and above said mold cavity, each of said channel being defined by lateral side walls, an open bottom end thereof in communication said mold cavity, and a pair of fins from said open bottom end of each of said lateral side of each of said channel, which extends from each of said lateral side wall of said channel into said mold cavity; and 2) Means for supporting said mold housing on a slip mold transporter C. Slip forming said first concrete structure by a. Placing said machine assembly, equipped with said tunnel mold, in slip forming relation to said iron work array; and b. Introducing concrete into said machine assembly for transfer into said tunnel mold assembly, while continuously moving machine assembly, equipped with said tunnel mold, over said iron work array, to slip form a first concrete structure with both rebars embedded in first concrete structure, and concrete free rebars, which extend from said iron work array embedded in said slip formed concrete structure.

2. The improved slip forming process of claim 1, wherein the tunnel mold assembly includes a plurality vibrating means within said mold cavity to effect consolidation of the concrete within said mold cavity and thereby eliminate any voids or lack of continuity of said concrete within the resultant slip formed structure.

3. The improved slip forming process of claim 1, wherein the tunnel mold assembly includes auger means for distribution of concrete within said tunnel mold cavity.

4. The improved slip forming process of claim 1, wherein the tunnel mold includes a pair of fins associated with each elongate channel, and extending there from into said unset concrete within said mold cavity, so as to prevent/minimizing unset concrete from flowing from within said mold cavity into each of said elongate channels and covering said rebars which extend into and pass through each of said channel.

5. The improved slip forming process of claim 1, wherein said iron work array is pre-configured to reinforce a bridge coping.

6. The improved slip forming process of claim 1, wherein said iron work array is pre-configured to reinforce a bridge coping and a road bed bad.

7. The improved slip forming process of claim 1, wherein said iron work array is pre-configured to reinforce a bridge coping and a wall to be formed on top of said coping.

8. A system for the slip forming of a reinforced concrete structure having both embedded and exposed rebars, said system comprising:

A. Providing a machine assembly for continuously molding of a reinforced first concrete highway structure upon an iron word array by slip forming concrete with a tunnel mold, said tunnel mold comprising, 1) A mold housing including a) A hopper, a mold cavity and one or more channels, i. Said hopper comprising a means for receiving concrete and directing flow of said concrete into said mold cavity, ii. Said mold cavity defining a shape of concrete structure to be formed on an iron work array, and iii. At least one channel comprising an elongate opening extending through said housing, from front to back of said housing, and into and above said mold cavity, each of said channel being defined by lateral side walls, an open bottom end thereof in communication said mold cavity, and a pair of fins from said open bottom end of each of said lateral side of each of said channel, which extends from each of said lateral side wall of said channel into said mold cavity; and 2) Means for supporting said mold housing on a slip mold transporter B. Means for transfer of unset concrete into said tunnel mold assembly, while continuously moving machine assembly, equipped with said tunnel mold, over said iron work array, to slip form a first concrete structure with both rebars embedded in said first concrete structure, and concrete free rebars, which extend from said iron work array embedded in said slip formed concrete structure; and C. Means for guidance and control of movement over said machine assembly relative to said iron work array.

9. The system of claim 8, wherein the tunnel mold assembly includes a plurality vibrating means within said mold cavity to effect consolidation of the concrete within said mold cavity and thereby eliminate any voids or lack of continuity of said concrete within the resultant slip formed structure.

10. The system of claim 8, wherein the tunnel mold assembly includes auger means for distribution of concrete within said tunnel mold cavity.

11. The system of claim 8, wherein the tunnel mold includes a pair of fins associated with tunnel and extending there from into said unset concrete within said mold cavity, so as to prevent/minimizing unconsolidated concrete from flowing from within said mold cavity into each of said tunnel and covering said rebars which extend into and pass through each of said channel.

12. The system of claim 8, wherein said iron work array is pre-configured to reinforce a bridge coping.

13. The system of claim 8, wherein said iron work array is pre-configured to reinforce a bridge coping and a road bed bad.

14. The system of claim 8, wherein said iron work array is pre-configured to reinforce a bridge coping and a wall to be formed on top of said coping.

15. A tunnel mold, comprising:

A. A mold housing including

1) A hopper, a mold cavity and one or more channels, i. Said hopper comprising a means for receiving concrete and directing flow of said concrete into said mold cavity, ii. Said mold cavity defining a shape of concrete structure to be formed on an iron work array, and iii. At least one tunnel comprising an elongate channel extending through said housing, from front to back of said housing, and into and above said mold cavity, each of said tunnel being defined by a pair of lateral side walls, an open bottom end thereof in communication said mold cavity, and a pair of fins from said open bottom end of each of said lateral side walls of each of said tunnel, which extends from each of said lateral side wall of said channel into said mold cavity; and 2) Means for supporting said mold housing on a slip mold transporter.

16. The tunnel mold of claim 15, wherein said hopper includes an auger for distribution of concrete within said hopper.

17. The tunnel mold of claim 15, wherein said mold assembly has more than one tunnel.

18. The tunnel mold of claim 15, wherein each of said channel has a pair of fins which are tapered from front to back, from said open bottom end of each of said lateral side of each of said tunnel.

19. The tunnel mold of claim 15, wherein said mold cavity defines a shape of concrete structure for road, bridge or highway barrier construction, having at least two inches of concrete cover relative to an iron work array to be embedded therein.

20. The tunnel mold of claim 19, wherein said mold cavity defines a shape of concrete structure in the form a bridge coping.

21. The tunnel mold of claim 19, wherein said mold cavity defines a shape of concrete structure, in the form a road pad.

22. The tunnel mold of claim 19, wherein said mold cavity defines a shape of a monolithic concrete structure having multiple structural components.

* * * * *